United States Patent [19]

Michelotti

[11] Patent Number: 5,058,362

[45] Date of Patent: Oct. 22, 1991

[54] APPARATUS FOR SEALING PACKAGING FOR FOODSTUFFS

[76] Inventor: William M. Michelotti, 184 Jonathan Dr., Stamford, Conn. 06903

[21] Appl. No.: 609,819

[22] Filed: Nov. 6, 1990

[51] Int. Cl.[5] ..... B65B 51/16

[52] U.S. Cl. ..... 53/387.3; 53/376.2; 493/135; 493/208

[58] Field of Search ..... 53/375.8, 375.9, 376.2, 53/387.3, 387.2; 493/266, 262, 189, 208, 135, 133, 132

[56] References Cited

U.S. PATENT DOCUMENTS

| | | | |
|---|---|---|---|
| 1,969,581 | 8/1934 | Rose | 53/387.3 X |
| 2,354,989 | 8/1949 | Fusco | 53/387.3 X |
| 2,421,373 | 6/1947 | Cozza | 53/387.3 |
| 2,727,345 | 12/1955 | Schoppee | 53/387.3 X |

*Primary Examiner*—James F. Coan

*Attorney, Agent, or Firm*—St. Onge Steward Johnston & Reens

[57] ABSTRACT

An overwrap machine for sealing packaging for a foodstuff comprises a conveyor belt, heating elements, and pluralities of modules holding rollers which contact the packaging as individual foodstuffs are conveyed by the modules. The modules, and thus the rollers, are heated by the heating elements. There are two different roller types, which are the cylindrical first rollers and the ellipsoidal second rollers. The pluralities of rollers include substantial numbers of the first rollers with fewer numbers of the second rollers interspersed therein. The ellipsoidal second rollers are effective to insure the sealing of the ends of the foodstuff being overwrapped by bearing against the unsealed ends as each foodstuff traverses the gap between opposing second rollers.

20 Claims, 2 Drawing Sheets

APPARATUS FOR SEALING PACKAGING FOR FOODSTUFFS

FIELD OF THE INVENTION

The present invention relates to the field of food packaging, and particularly to shrinkwrap and overwrap machines for packaging resilient foodstuffs such as bread.

BACKGROUND OF THE INVENTION

Commercial bakeries often package baked bread in an overwrap, which is a plastic package that contains the bread. This overwrap may be the sole airtight packaging for the bread or it may be contained within a plastic bag tied with a twist tie or other closure.

The bread overwrap typically comprises a sheet of transparent polypropylene which must be sealed at both ends to retain freshness. In the past, the ends of an overwrap have been folded to a desired closure and then sealed in place by a bread overwrap machine. The loaves of bread are conveyed sideways through such an overwrap machine such that the wrap at the ends of the loaves would be sealed as the loaves were conveyed through the machine. Traditionally, the overwrap machine has used a heated mesh belt to contact the ends of the bread and packaging to fuse and seal the ends. More recently, the inventor herein has developed an overwrap machine in which uniformly cylindrical rollers have been used in place of the mesh belt to obtain a sealing of the ends.

SUMMARY OF THE INVENTION

It is an object of the invention to provide an apparatus for sealing the overwrap packaging of foodstuffs such as bread. It is an object of the invention to provide such an apparatus which improves the reliability and effectiveness of sealing. It is an object of the invention to provide an apparatus which is readily cleanable—an important consideration in the making and packaging of foodstuffs.

The invention, in one embodiment, generally comprises means for conveying a foodstuff; means for heating; a first plurality of uniform diameter generally cylindrical first rollers heated by the heating means such that the first rollers are sufficiently heated to seal the packaging of the foodstuff; and a second plurality of second rollers, at least a portion of the second rollers having a diameter which is larger than the diameter of the first rollers, heated by the heating means such that the second rollers are sufficiently heated to seal the packaging of the foodstuff.

Preferably, the diameter of the second rollers is variable over the length of the second roller, and most preferably they are generally ellipsoidal in shape.

There are preferably groups of from about four to about twenty of the first rollers separated by groups of from about one to about four of the second rollers. Most preferably, there are groups of about twelve of the first rollers separated by groups of two of the second rollers. There are preferably pluralities of such first and second rollers which face each other across the conveying means, with the first rollers facing the first rollers, and the second rollers facing the second rollers.

The first rollers are preferably contained in modules each having no more than about four rollers, and the second rollers are similarly contained in modules containing no more than two second rollers.

The modules containing the rollers act as heat sinks, and are heated by the heating means. Heat is transferred from the module to the roller by conduction and radiative heating. The rollers preferably include a jacket of a non-stick thermally conductive material. The modules are separately removable from the apparatus for cleaning.

In another embodiment, the invention comprises an apparatus having arrays of said ellipsoidal rollers to seal the packaging of a foodstuff.

Other objects, aspects and features of the present invention in addition to those mentioned above will be pointed out in detail or will be understood from the following detailed description provided in conjunction with the accompanying drawings.

DETAILED DESCRIPTION OF THE INVENTION

Figure 1:
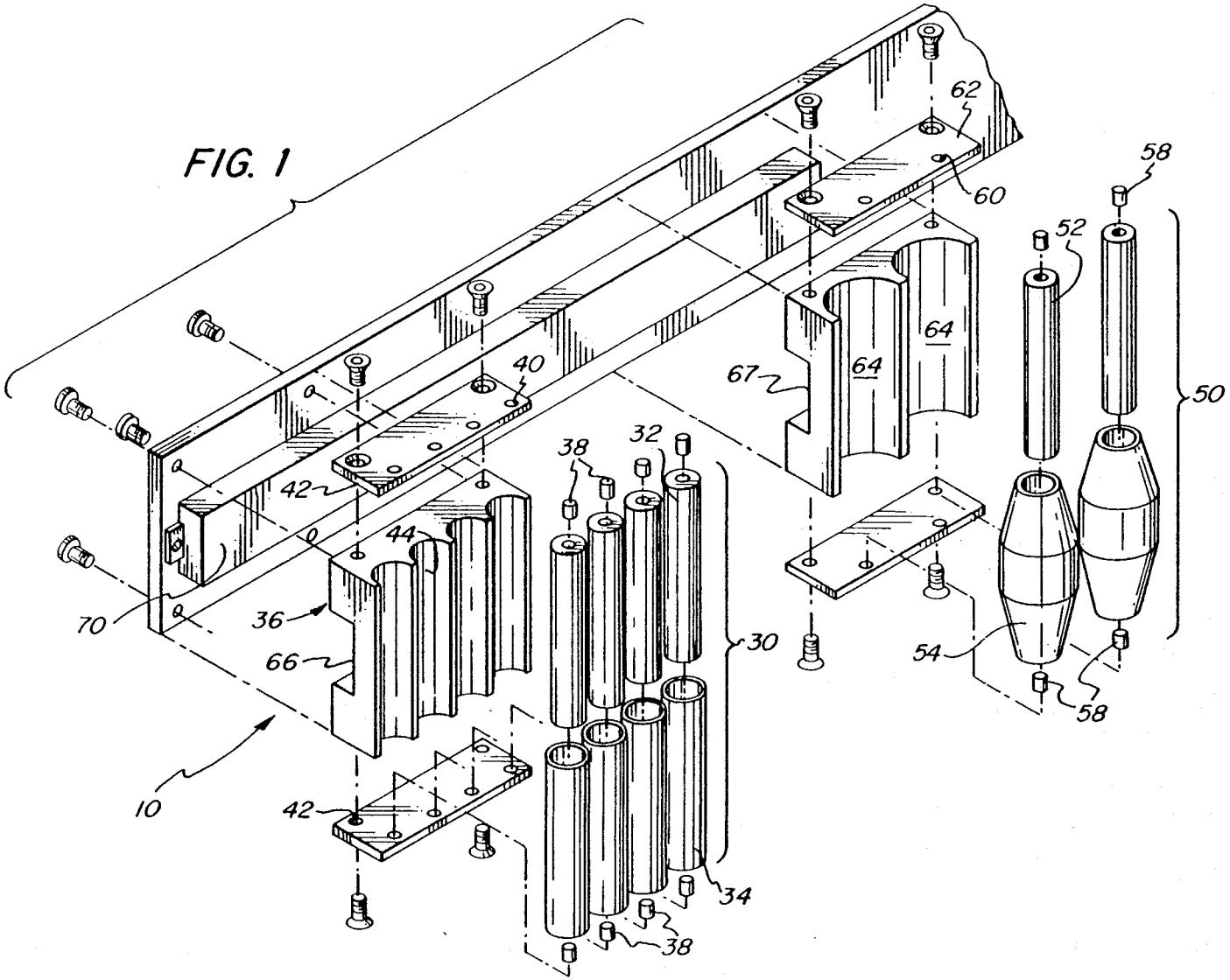
FIG. 1 is an exploded perspective view of modules containing first and second rollers in one embodiment of the apparatus of the invention.
Figure 2:
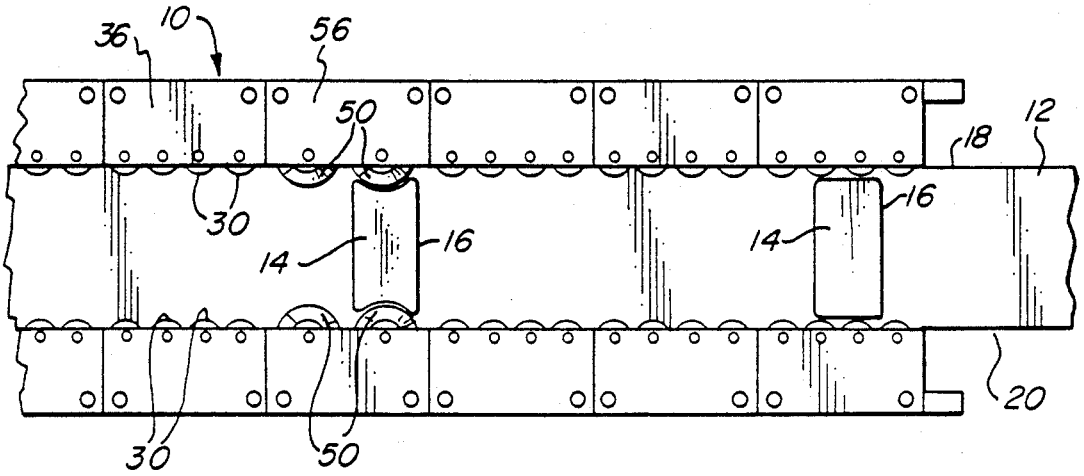
FIG. 2 is a top plan view of an embodiment of the apparatus of the invention.
Figure 3:
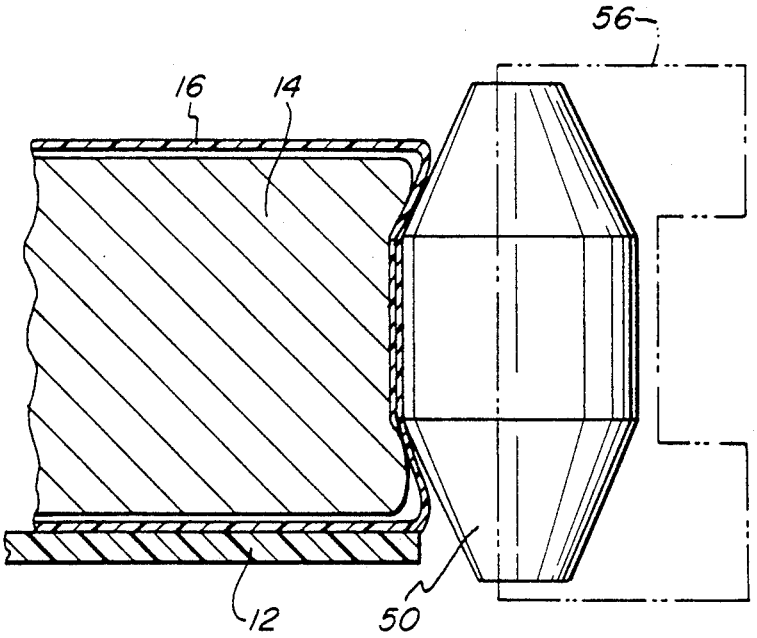
FIG. 3 is a front cross-sectional view showing a second roller of the apparatus of FIG. 2 bearing against a packaging and a foodstuff.

Referring now to FIGS. 1-3, an apparatus 10 for sealing packaging of foodstuffs is shown. Apparatus 10 has a means 12 for conveying a foodstuff 14 wrapped in a packaging 16 thereon. Means 12 may comprise a moving bed of support bars, or a conveyor belt, or an array of rollers, or other types of food carrying devices, and preferably also includes pushing arms supported above the moving bed or belt and synchronized therewith. Foodstuff 14 is typically a baked product such as a loaf of bread. Packaging 16 is an overwrap formed of transparent polypropylene. Conveying means 12 has two lateral sides 18 and 20.

Disposed on each lateral side 18 and 20 are pluralities of first rollers 30 and second rollers 50. As used herein, "plurality" includes a single element as well as multiple elements, unless otherwise defined. First rollers 30 are uniform diameter cylindrical rollers. First rollers 30 are mounted in a module 36 adapted to hold a plurality, preferably four, of the first rollers 30. Module 36 has a substantial heat capacity and is made from aluminum. First rollers 30 comprise an inner roller 32 made of aluminum and an outer jacket 34 made from a thermally conductive yet non-stick material, preferably "Rulon". Rulon is a trademark for a fluoropolymer (TFE) made by Dixon Corporation and available through distributors such as AIN Plastics, Mount Vernon, N.Y. Rulon has the property of relatively high thermal conductivity, in the range of 2.3 B.T.U./hr./sq.ft./°F./in., combined with a very low coefficient of friction, in the range of 0.04–0.16 for static dry friction, and in the range of 0.12–0.19 for dynamic dry coefficient of friction against steel.

The combination of thermally conductive and non-stick properties is highly effective to seal packaging such as polypropylene sheet while minimizing undesirable accumulation or sticking of the packaging to the rollers.

First rollers 30 are mounted in module 36 by steel pins 38 fitting into apertures 40 in steel flanges 42 of module 36. The face of module 36 has a plurality of channels 44 for receiving the rollers 30. Preferably, the channels 44 are semi-cylindrical and are sized such that the rollers 30 fit with close clearance therein. The close fit and enclosure of the channels 44 about rollers 30 is desirable to increase heat transfer from the module 36 to the rollers 30. Heat also is transferred to the rollers 30 from module 36 through the pins 38.

Second rollers 50 have a diameter, at least a portion of which is greater than the diameter of the first rollers. Preferably, the second rollers 50 are ellipsoidal. As used herein "ellipsoidal" encompasses a variety of shapes having a larger diameter cross-sectional central portion and smaller diameter cross-sectional end portions with a tapering diameter between those central and end portions, and includes, inter alia, generally football shaped rollers, as well as cylindrical central sections joined to conical or conical frustum end portions such as shown in FIG. 1.

Second rollers 50 are mounted in a module 56 adapted to hold a plurality, preferably two, of the second rollers 50. Module 56 has a substantial heat capacity and is made from aluminum. Second rollers 50 comprise an inner roller 52 made of aluminum and an outer jacket 54 made from Rulon. Second rollers 50 are mounted in module 56 by steel pins 58 fitting into apertures 60 in steel flanges 62 of module 56. The face of module 56 has a plurality of channels 64 for receiving the rollers 50. Preferably, the channels 64 are semi-cylindrical and are sized such that the rollers 50 fit with close clearance therein.

As can be seen in FIG. 2, the modules 36 and 56 are disposed on both lateral sides 18 and 20 of the conveying means 12, with pluralities of the first rollers 30 facing each other on opposite lateral sides 18 and 20 of the conveying means 12. Pluralities of second rollers 50 preferably also face each other on opposite lateral sides 18 and 20 of the conveying means 12.

Means for heating the heat sealing modules 36 and 56 are provided as shown in FIG. 1 and preferably comprise an electrical resistance heating bar 70. Heating bar 70 is preferably sized to match notches 66 and 67 in the modules 36 and 56 respectively. Heating bar 70 is thus in thermally conductive contact with the modules 36 and 56 to heat the modules, and thereby heat the rollers 30 and 50.

In order for the rollers 30 and 50 to be maintained at a desired temperature, a temperature control unit is provided to control the current provided to electrical heating bar 70. The temperature control unit senses the temperature at the modules 36 and 56 and controls the temperature to be between about 260°-300° F.

In the apparatus of the invention, a foodstuff to be packaged is wrapped in a sheet of packaging material, in which the ends are folded up to a desired wrap. The foodstuff is then passed through the apparatus 10. The first and second pluralities of rollers 30 and 50 are disposed on both lateral sides of the conveying means 20 at a distance apart sufficient to permit the heated rollers 30 and 50 to contact two ends of the packaging and foodstuff conveyed in the conveying means and to thereby seal the ends of the packaging.

As shown in FIG. 3, the second rollers 50 of the present invention are particularly useful to seal packaging 16 of a resilient foodstuff 14 such as a loaf of bread. The second rollers 50 press against the end of the foodstuff 14 to cause the packaging 16 to press on and seal against itself.

If desired, the second module 56 and/or the mountings for the second rollers 50 may be provided with spring resilient means to permit the second rollers 50 to resiliently bear against the foodstuff without crushing the foodstuff.

Preferably the modules 36 and 56 are suspended above the conveying means 12 and arrays of such modules located on opposite sides 18 and 20 of the conveying means 12 are movable towards and away from each other, to accommodate foodstuffs of varying lengths and size. The movable modules 36 and 56 permit the sealing rollers 30 and 50 to be precisely located for optimum sealing effectiveness.

In the apparatus 10 there are preferably a sufficient number of first modules 36 to form pluralities of about four to about twenty of the first rollers 30. These pluralities of first rollers 30 are separated by a sufficient number of second modules 56 to form a plurality of from about one to about four of the second rollers 50 between the pluralities of the first rollers 30. More preferably, there are pluralities of about twelve of the first rollers 30 separated by a plurality of two of the second rollers 50.

In an alternative embodiment of the invention, the first cylindrical rollers are omitted and the sealing is effected by pluralities of second rollers 150 having the characteristics of the rollers 50 described above.

Accordingly, the present invention provides an improved and effective apparatus for sealing the ends of packaging in a foodstuff such as a loaf of bread. The modular design permits simple disassembly for cleaning, and subsequent reassembly.

I claim:

1. Apparatus for sealing packaging for foodstuffs comprising:

means for conveying foodstuff wrapped in a packaging thereon and having two lateral sides;

means for heating disposed on at least one lateral side of said conveying means;

a first plurality of uniform diameter generally cylindrical first rollers disposed on said at least one lateral side of said conveying means and operably connected to said heating means such that said first rollers are sufficiently heated to seal the packaging of the foodstuff;

a second plurality of second rollers disposed on said at least one lateral side of said conveying means, at least a portion of said second rollers having a diameter which is larger than the diameter of said first rollers whereby said second rollers have a varying diameter and are generally ellipsoidal, said second rollers being operably connected to said heating means such that said second rollers are sufficiently heated to seal the packaging of the foodstuff.

2. Apparatus in accordance with claim 1 wherein there are groups of from about four to about twenty of said first rollers separated by groups of from about one to about four of said second rollers.

3. Apparatus in accordance with claim 2 wherein there are groups of about twelve of said first rollers separated by groups of two of said second rollers.

4. Apparatus in accordance with claim 3 wherein said heating means and first and second pluralities of rollers are disposed on both lateral sides of said conveying means at a distance apart sufficient to permit said rollers to contact two ends of a packaging for a foodstuff conveyed in said conveying means and to thereby seal the ends of the packaging.

5. Apparatus in accordance with claim 4 wherein pluralities of first rollers face each other on opposite lateral sides of said conveying means and wherein pluralities of second rollers face each other on opposite lateral sides of said conveying means.

6. Apparatus in accordance with claim 3 wherein said first rollers are contained in modules each having no more than about four first rollers.

7. Apparatus in accordance with claim 5 wherein said second rollers are contained in modules each having no more than two second rollers.

8. Apparatus in accordance with claim 5 wherein said first and second rollers are rollably mounted in and in thermally conductive contact with heat sinks located to be heated by said heating means.

9. Apparatus in accordance with claim 1 wherein wherein said rollers further comprise a jacket formed of a thermally conductive non-stick material.

10. Apparatus for sealing packaging for foodstuffs comprising:

means for conveying a foodstuff wrapped in a packaging thereon and having two lateral sides;

means for heating heat sealing modules;

a plurality of heat sealing modules disposed on both lateral sides of said conveying means, said heat sealing modules containing ellipsoidal rollers positioned to contact the packaging of the ends of a foodstuff conveyed on said conveying means, said ellipsoidal rollers having a variable diameter, said ellipsoidal rollers having an outer surface comprising a thermally conductive non-stick material and being heated by said heating means such that said ellipsoidal rollers are sufficiently heated to seal the packaging of the foodstuff.

11. Apparatus for sealing packaging for foodstuffs comprising:

means for conveying a foodstuff wrapped in a packaging thereon and having two lateral sides;

means for heating disposed on at least one lateral side of said conveying means;

a first plurality of uniform diameter generally cylindrical first rollers disposed on said at least one lateral side of said conveying means and having a jacket formed of a thermally conductive non-stick material and being operably connected to said heating means such that said first rollers are sufficiently heated to seal the packaging of the foodstuff;

a second plurality of second rollers disposed on said at least one lateral side of said conveying means, at least a portion of said second rollers having a diameter which is larger than the diameter of said first rollers and each said second roller having a jacket formed of a thermally conductive non-stick material, said second rollers being operably connected to said heating means such that said second rollers are sufficiently heated to seal the packaging of the foodstuff.

12. Apparatus for sealing packaging for foodstuffs comprising:

means for conveying a foodstuff wrapped in a packaging thereon and having two lateral sides;

means for heating heat sealing modules;

a plurality of heat sealing modules disposed on both lateral sides of said conveying means, said heat sealing modules having a substantial heat capacity and including first modules containing a plurality of uniform diameter cylindrical first rollers having an exposed surface formed of a polymeric non-stick material and positioned to contact the packaging of the ends of a foodstuff conveying on said conveying means, said rollers being heated by said heating means such that said first rollers are sufficiently heated to seal the packaging of the foodstuff; and second modules containing ellipsoidal second rollers having an exposed surface formed of a polymeric non-stick material and positioned to contact the packaging of the ends of a foodstuff conveyed on said conveying means, said second rollers having a variable diameter, at least a portion of said diameters of said second rollers being larger than the diameter of said first rollers, said second rollers being heated by said heating means such that said second rollers are sufficiently heated to seal the packaging of the foodstuff.

13. Apparatus in accordance with claim 12 wherein there are a sufficient number of first modules to form pluralities of about four to about twenty of said first rollers separated by a sufficient number of second modules to form a plurality of from about one to about four of said second rollers between said pluralities of said first rollers.

14. Apparatus in accordance with claim 13 wherein there are pluralities of about twelve of said first rollers separated by a plurality of two of said second rollers.

15. Apparatus in accordance with claim 12 wherein each said first module contains four said first rollers and each said second module contains two of said second rollers.

16. Apparatus in accordance with claim 12 wherein wherein said exposed surface of said first and second rollers comprises a jacket formed of a thermally conductive non-stick material.

17. Apparatus in accordance with claim 12 wherein pluralities of first rollers face each other on opposite lateral sides of said conveying means and wherein pluralities of second rollers face each other on opposite lateral sides of said conveying means.

18. In an overwrap machine for sealing packaging for foodstuffs having means for conveying a foodstuff wrapped in a packaging thereon and having two lateral sides; and means for heating; the improvement comprising:

a plurality of heat sealing modules disposed on both lateral sides of said conveying means, said heat sealing modules having a substantial heat capacity for heating by said heating means and including:

first modules containing uniform cylindrical first rollers positioned to contact the packaging of the ends of a foodstuff conveyed on said conveying means, said rollers being heated by said heating means such that said first rollers are sufficiently heated to seal the packaging of the foodstuff; and second modules containing ellipsoidal second rollers positioned to contact the packaging of the ends of a foodstuff conveyed on said conveying means, said rollers being heated by said heating means such that said second rollers are sufficiently heated to seal the packaging of the foodstuff, said second rollers modules being interspersed with said first rollers modules; and said first rollers facing each other on opposite lateral sides of said conveying means and said second rollers facing each other on opposite lateral sides of said conveying means, whereby said first rollers and particularly said second rollers bear against the ends of said packaging for foodstuff to thereby seal said packaging.

19. The improvement in an overwrap machine in accordance with claim 18 wherein each said roller is jacketed with a fluoropolymeric non-stick material.

20. The improvement in an overwrap machine in accordance with claim 19 wherein there are a sufficient number of first modules to form pluralities of about four to about twenty of said first rollers separated by a sufficient number of second modules to form a plurality of from about two to about four of said second rollers between said pluralities of said first rollers.

* * * * *